US008170442B2

(12) United States Patent
Sato et al.

(10) Patent No.: US 8,170,442 B2
(45) Date of Patent: May 1, 2012

(54) DEVELOPING CARTRIDGE AND IMAGE FORMING APPARATUS

(75) Inventors: Fumikazu Sato, Konan (JP); Hideshi Nishiyama, Nagoya (JP); Tsutomu Suzuki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 527 days.

(21) Appl. No.: 12/353,591

(22) Filed: Jan. 14, 2009

(65) Prior Publication Data

US 2009/0180816 A1 Jul. 16, 2009

(30) Foreign Application Priority Data

Jan. 15, 2008 (JP) ..... 2008-005528

(51) Int. Cl.
*G03G 15/08* (2006.01)

(52) U.S. Cl. ..... 399/103; 399/119; 399/274; 399/284

(58) Field of Classification Search ..... 399/103, 399/111, 119, 274, 284
See application file for complete search history.

(56) References Cited

U.S. PATENT DOCUMENTS

| | | | | |
|---|---|---|---|---|
| 5,499,082 | A | 3/1996 | Watanabe et al. | |
| 6,654,575 | B2 | 11/2003 | Miura et al. | |
| 7,058,349 | B2 * | 6/2006 | Kamimura | 399/361 |
| 7,239,824 | B2 | 7/2007 | Fukuta | |
| 7,362,986 | B2 | 4/2008 | Okabe et al. | |
| 2006/0093399 | A1 | 5/2006 | Okabe et al. | |
| 2008/0138108 | A1 | 6/2008 | Okabe et al. | |

FOREIGN PATENT DOCUMENTS

| | | | |
|---|---|---|---|
| JP | 05-289521 | | 6/1993 |
| JP | 11-119545 | | 4/1999 |
| JP | 2001-027844 | A | 1/2001 |
| JP | 2002-207409 | | 7/2002 |
| JP | 2003-215914 | A | 7/2003 |
| JP | 2005-070395 | A | 3/2005 |
| JP | 2005-114956 | | 4/2005 |
| JP | 2006-039216 | A | 2/2006 |
| JP | 2006-098770 | | 4/2006 |
| JP | 2006-154744 | A | 6/2006 |
| JP | 2006-267679 | | 10/2006 |
| JP | 2007-025250 | A | 2/2007 |

OTHER PUBLICATIONS

JP Office Action dtd Feb. 7, 2012, JP Appln. 2008-005528, English translation.

* cited by examiner

*Primary Examiner* — Hoang Ngo
(74) *Attorney, Agent, or Firm* — Banner & Witcoff, Ltd.

(57) ABSTRACT

A developing cartridge includes a first frame including a first wall at one end thereof, a second frame including a pair of second walls facing with each other and a third wall that connects the pair of second walls, an opening that is formed by the first wall, the pair of second walls and the third wall, and a support that is interposed between the third wall and the first wall so as to support the first wall by the third wall.

33 Claims, 11 Drawing Sheets

DEVELOPING CARTRIDGE AND IMAGE FORMING APPARATUS

CROSS-REFERENCE TO RELATED APPLICATIONS

This application claims priority from Japanese Patent Application No 2008-005528 filed on Jan. 15, 2008, the entire subject matter of which is incorporated herein by reference.

TECHNICAL FIELD

Apparatuses consistent with the invention relate to a developing cartridge including an upper frame and a lower frame and an image forming apparatus having the developing cartridge.

BACKGROUND

There has been proposed an image forming apparatus, such as a laser printer, having a photosensitive drum carrying a toner image and a transfer roller attracting the toner image, both of which remain in contact with each other. When a sheet passes between the photosensitive drum and the transfer roller, the toner image moves to a transfer roller and is transferred to the sheet so as to produce an image. Incidentally, such an image forming apparatus has a developing cartridge for feeding toner to the photosensitive drum.

JP-A-2006-98770 discloses a related art developing cartridge including a box-shaped case having an oblong opening; a developing roller that is exposed through the opening of the case and that feeds toner to the photosensitive drum; a layer thickness regulation blade that makes a slidable contact with the developing roller to regulate the thickness of toner on the developing roller to a predetermined thickness; and a seal member that stops up a gap between the developing roller, the layer thickness regulation blade, and an edge of the opening of the case.

The related art developing cartridge is divided into an upper frame, which has a plate-shape and is provided at the layer thickness regulation blade side with reference to the developing roller, and a lower frame having the edge of the opening. A part of the edge of the opening that nips the seal member between the edge and the layer thickness regulation blade is formed as a beam-like portion that extends across right and left sidewalls of the lower frame. In this structure, a front end portion of the upper frame (i.e., an opening-side portion of the upper frame) is supported by the beam-like portion, and right and left end portions and a rear end portion of the upper frame are supported by the right and left walls and a rear wall of the lower frame.

However, the related art developing cartridge has some disadvantages. For example, when the lower frame has the beam-like portion, die cutting must be performed from a front opening of the lower frame to the front and from an upper opening of the lower frame upward. Thus, production method of the related art developing cartridge becomes complicated.

SUMMARY

Illustrative aspects of the invention provide a developing cartridge, which includes an upper frame, a lower frame, a beam-like portion that is integrally formed in the upper frame, and which enhances rigidity of a front-end portion (i.e., an opening-side portion) of the upper frame. Illustrative aspects of the invention also provide an image forming apparatus including the developing cartridge.

According to a first illustrative aspect of the invention, there is provided a developing cartridge comprising: a first frame comprising a first wall at one end thereof; a second frame comprising: a pair of second walls facing with each other, and a third wall that connects the pair of second walls; an opening that is formed by the first wall, the pair of second walls and the third wall; and a support that is interposed between the third wall and the first wall so as to support the first wall by the third wall.

According to a second illustrative aspect of the invention, there is provided an image forming apparatus comprising: a plurality of the developing cartridges, each developing cartridge comprising: a first frame comprising a first wall at one end thereof; a second frame comprising: a pair of second walls facing with each other; and a third wall that connects the pair of second walls; an opening that is formed by the first wall, the pair of second walls and the third wall; a support that is interposed between the third wall and the first wall so as to support the first wall by the third wall; a developer carrier that is exposed to the opening; a layer thickness regulation member, which is provided between the developer carrier and the first wall so as to regulate thickness of a developer on the developer carrier; a first seal member that closes a gap between the layer thickness regulation member and the first wall, wherein the layer thickness regulation member comprises: a first plate-shaped portion that nips the first seal member between the first plate-shaped portion and the first wall; and a second plate-shaped portion that is bent from the first plate-shaped portion so as to extend along a surface of the first frame opposite to the second frame, wherein both ends of the layer thickness regulation member are secured to the pair of second walls, and wherein both ends of the second plate-shaped portion are secured to the pair of second walls, wherein the plurality of developing cartridges are arranged along a direction in which the first frame and the second frame oppose each other.

According to the illustrative aspects of the invention, in the structure where the first wall is formed integrally on the first frame, one end of the first frame is supported by the third wall of the second frame. Therefore, the rigidity of the one end of the first frame can be enhanced.

Further, in the image forming apparatus according to the illustrative aspects of the invention, both ends of the second plate-shaped portion of the layer thickness regulation member are secured to the pair of second walls of the second frame. Therefore, for example, when compared with a structure in which the first seal member is placed at a base end of the first plate-shaped portion of the layer thickness regulation member and where the distal end of the first plate-shaped portion is secured to the second wall, the length of the first plate-shaped portion and the length of the first wall can be reduced. Accordingly, the size of the developing cartridge can be reduced in a direction where the first frame and the second frame oppose each other.

DETAILED DESCRIPTION

Figure 1:
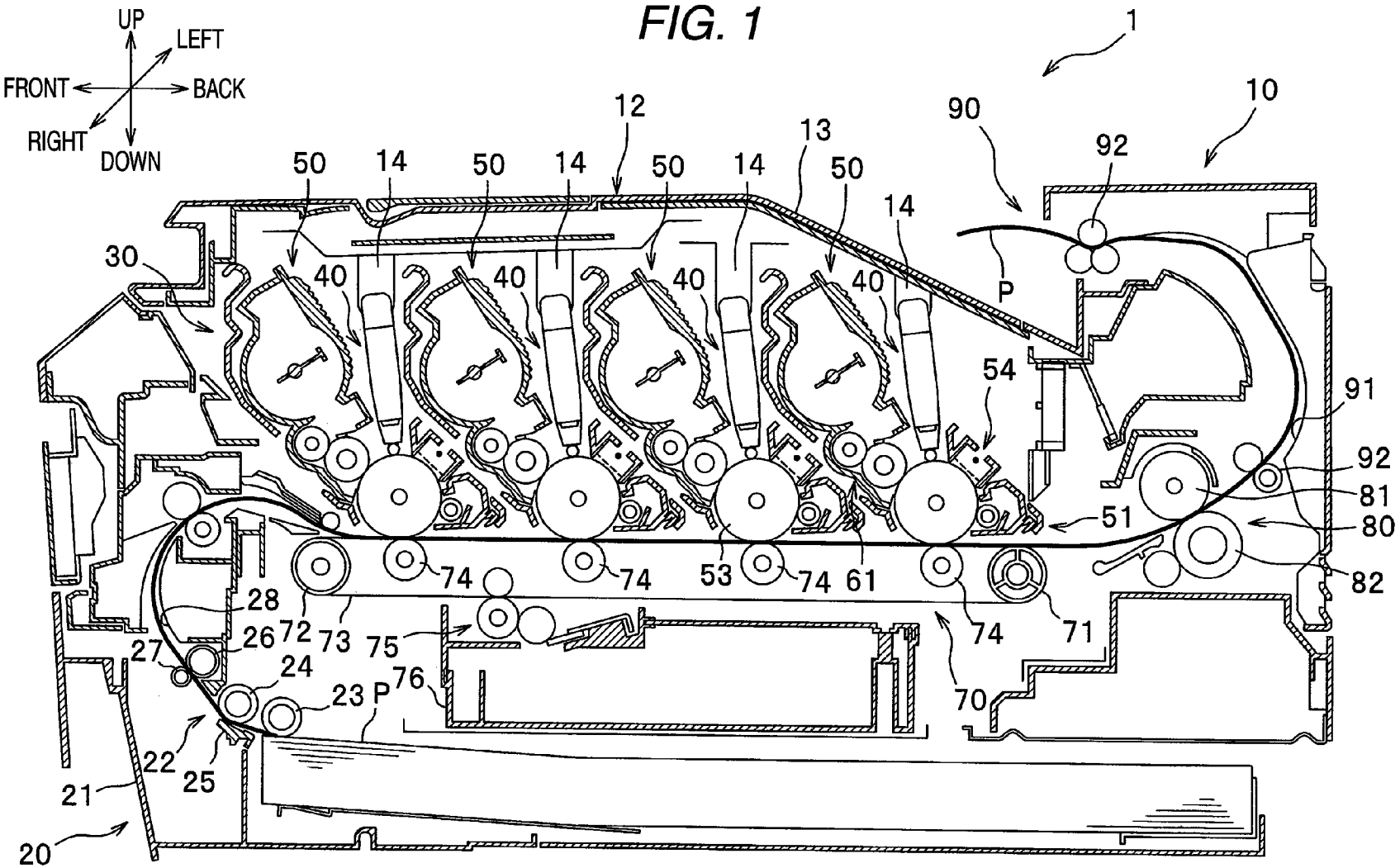
FIG. 1 is a cross-sectional view of an image forming apparatus according to an exemplary embodiment of the invention.

Exemplary embodiments of the invention will now be described with reference to the drawings.

In order to simplify the manufacturing method of the related art developing cartridge, the beam-like portion may be provided on the upper frame without providing the lower frame with the beam-like portion. In this case, process of forward die cutting may not be required during die cutting of the lower frame.

However, in such a case where the upper frame includes the beam-like portion, a front end portion (i.e., the beam-like portion) of the upper frame may not be supported by the lower frame.

Therefore, Illustrative aspects of the invention provide a developing cartridge, which includes an upper frame, a lower frame, a beam-like portion that is integrally formed in the upper frame, and which enhances rigidity of a front-end portion (i.e., an opening-side portion) of the upper frame. Illustrative aspects of the invention also provide an image forming apparatus including the developing cartridge.

(Image Forming Apparatus)

In the following descriptions, directions will be described by reference to directions determined with respect to a user when an image forming apparatus is used. Note that, in the following description, when directions are mentioned, the directions refer to directions indicated by arrows in each of the accompanying drawings. For example, in FIG. 1, the left side of a drawing sheet is taken as a "front side"; the right side of the drawing sheet is taken as a "rear side"; a deep interior side of the drawing sheet is taken as a "left side"; and a viewer side of the drawing sheet is taken as a "right side." The vertical direction of the drawings sheet is also taken as the "vertical direction."

As shown in FIG. 1, an image forming apparatus 1 includes, in a main housing 10, a feeder unit 20 that supplies a sheet P, an image forming unit 30 that produces an image on a fed sheet P, and a sheet discharge part 90 that discharges the sheet P having the produced image. A color printer is one example of the image forming apparatus 1.

A reclosable upper cover 12 is provided at an upper part of the main housing 10 so as to be vertically rotatable around a hinge (not shown) provided on a rear side as a fulcrum. An upper surface of the upper cover 12 functions as a sheet discharge tray 13 that accumulates the sheets P discharged from the main housing 10. A plurality of hold members 14 for holding an LED unit 40 (described later) are provided on a lower surface of the upper cover 12.

The feeder unit 20 is provided in a lower part of the main housing 10. The feeder unit 20 includes a sheet feeding tray 21 and a sheet feeding mechanism 22. The sheet feeding tray is removably attached to the main housing 10. The sheet feeding mechanism 22 conveys the sheet P from the sheet feeding tray 21 to the image forming unit 30. The sheet feeding mechanism 22 is provided in short of the sheet feeding tray 21 and includes a sheet feeding roller 23, a separation roller 24, and a separation pad 25.

In the feeder unit 20, the sheets P in the sheet feeding tray 21 are separated one at a time and conveyed upwardly, and paper dust is removed in the middle of the sheet passing between a paper dust removal roller 26 and a pinch roller 27. Subsequently, the sheet is changed in direction backwardly by passing through a conveyance path 28 and fed to the image forming unit 30.

The image forming unit 30 includes four LED units 40, four process cartridges 50, a transfer unit 70, and a fixing unit 80.

Figure 2:
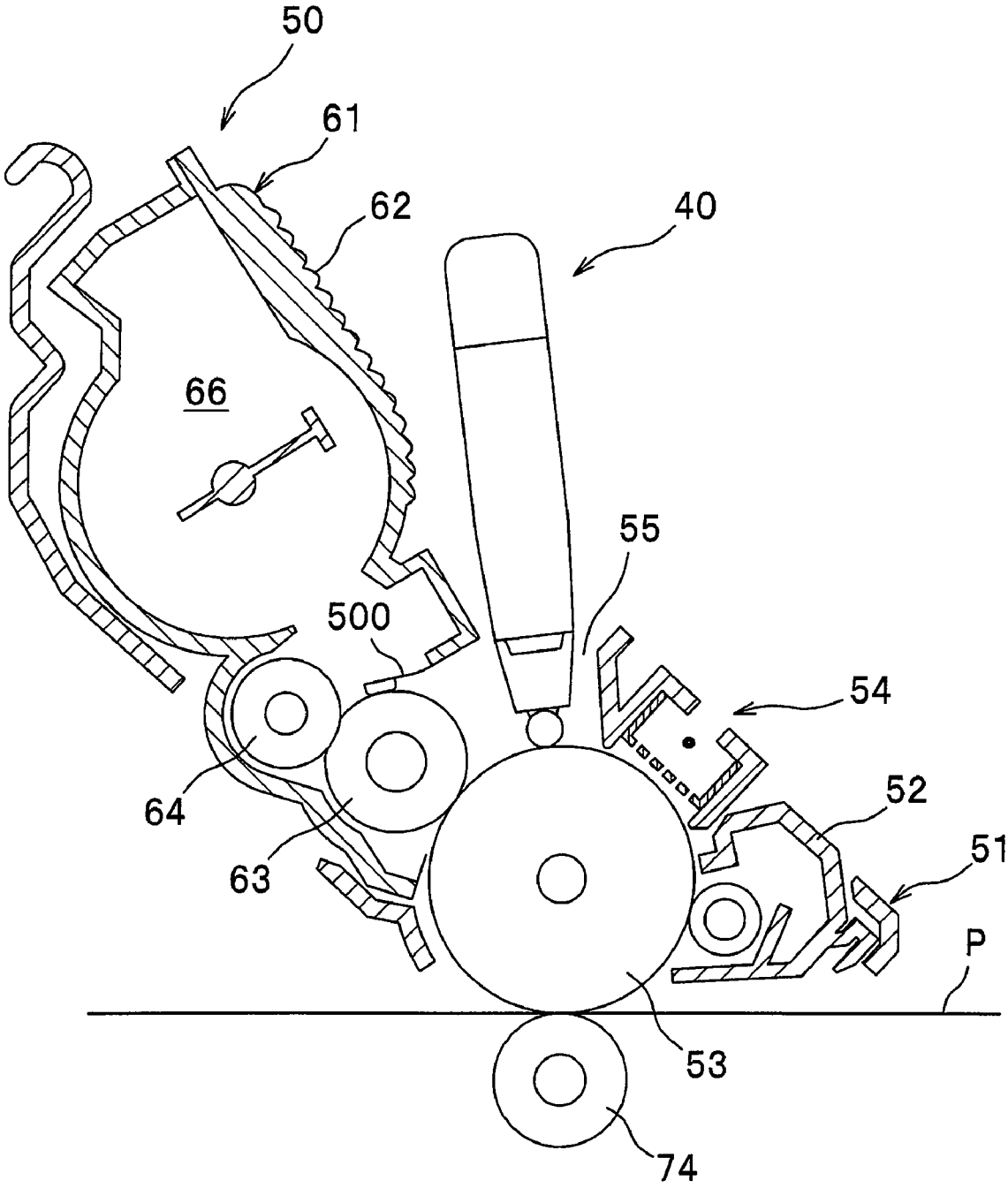
FIG. 2 is an enlarged cross-sectional view of a process cartridge.

The process cartridges 50 are arranged in a front-back direction between the upper cover 12 and the feeder unit 20. As shown in FIG. 2, each of the process cartridges 50 has a drum unit 51 and a developing cartridge 61 that is removably attached to the drum unit 51. The process cartridges 50 are identical in configuration with each other, except for the color of developer accommodated in developer accommodation chambers 66 of the developing cartridges 61. Toner is one example of the developer.

Each of the drum units 51 includes a drum frame 52, a photosensitive drum 53 that is rotatably supported by the drum frame 52, and a charger 54.

Each of the drum frames 52 is arranged such that an exposure hole 55, through which the photosensitive drum 53 faces outside, is opened as a result of the developing cartridge 61 being attached to the drum frame. The LED unit 40 is inserted into the exposure hole 55 so as to oppose the surface of an upper portion of the photosensitive drum 53.

As well as having the developer accommodation chamber 66 that accommodates developer, the developing cartridge 61 includes a developing frame 62, a developing roller 63, a supply roller 64, and a blade assembly 500. The developing roller 63 and the supply roller 64 are rotatably supported by the developing frame 62. The developing roller 63 is an example of a developer carrier. The blade assembly 500 is an example of a layer thickness regulation member. Incidentally, FIG. 2 shows the structure of the developing cartridge 61 in a simplified fashion, and detailed structure of the developing cartridge 61 will be described later.

As shown in FIG. 1, the transfer unit 70 is interposed between the feeder unit 20 and the respective process cartridges 50. The transfer unit 70 includes a drive roller 71, a driven roller 72, a conveyance belt 73, transfer rollers 74, and a cleaning unit 75.

The drive roller 71 and the driven roller 72 are positioned in parallel to each other while being spaced in a front-back direction. The conveyance belt 73 built from an endless belt is stretched between the drive roller 71 and the driven roller 72. An outer surface of the conveyance belt 73 remains in contact with the respective photosensitive drums 53. Four transfer rollers 74 are provided inside of the conveyance belt 73 and opposite the respective photosensitive drums 53. The conveyance belt 73 is nipped between the transfer rollers 74 and the respective photosensitive drums 53. During transfer operation, a transfer bias is applied to the transfer rollers 74 by constant current control.

The cleaning unit 75 is positioned below the conveyance belt 73 and is configured so as to remove the developer adhered to the conveyance belt 73. Accordingly, the removed developer falls into a developer storage unit 76 provided below the cleaning unit 75.

A fixing unit 80 is provided at the rear of the respective process cartridges 50 and the transfer unit 70. The fixing unit 80 includes a heating roller 81 and a press roller 82. The press roller 82 is positioned opposite the heating roller 81 and presses the heating roller 81.

In the image forming unit 30, surfaces of the respective photosensitive drums 53 are first uniformly charged by the chargers 54 and subsequently exposed to light emitted from the respective LED units 40. Exposed portions of the surfaces of the photosensitive drums 53 are subjected to a reduction in electric potential, whereupon electrostatic latent images based on image data are produced on the respective photosensitive drums 53.

Developer is fed from the developer accommodation chambers 66 to the developing rollers 63 by rotation of the supply rollers 64. Then, the developer enters between the developing rollers 63 and the blade assembly 500 by rotation of the developing rollers 63, whereupon the developer is held on the respective developing rollers 63 as a thin layer.

When the developing rollers 63 contact the respective photosensitive drums 53 in an opposing manner, the developer held on the respective developing rollers 63 is fed to the electrostatic latent images produced on the respective photosensitive drums 53. The developer is thereby selectively held on the respective photosensitive drums 53, and the electrostatic latent images are visualized, whereupon developer images are produced by reversal development.

The transfer rollers 74 are positioned inside of the conveyance belt 73. As a result of the sheet P supplied onto the conveyance belt 73 passing between the respective photosensitive drums 53 and the respective transfer rollers 74, the developer images produced on the respective photosensitive drums 53 are transferred onto the sheet P. When the sheet P passes between the heating roller 81 and the press roller 82, the developer image transferred onto the sheet P is thermally fixed.

The sheet discharge part 90 includes a sheet-discharge-side conveyance path 91, which is formed to extend upwardly from an exit of the fixing unit 80 and makes a turn to the front, and a plurality of pairs of conveyance rollers 92 that convey the sheet P. The sheet P, on which the developer image has been transferred and thermally fixed, is conveyed along the sheet-discharge-side conveyance path 91 by conveyance rollers 92 and discharged to the outside of the main housing 10. The sheet P is then accumulated on the sheet discharge tray 13.

(Developing Cartridge)

The structure of the developing cartridge 61 will now be described.

Figure 3:
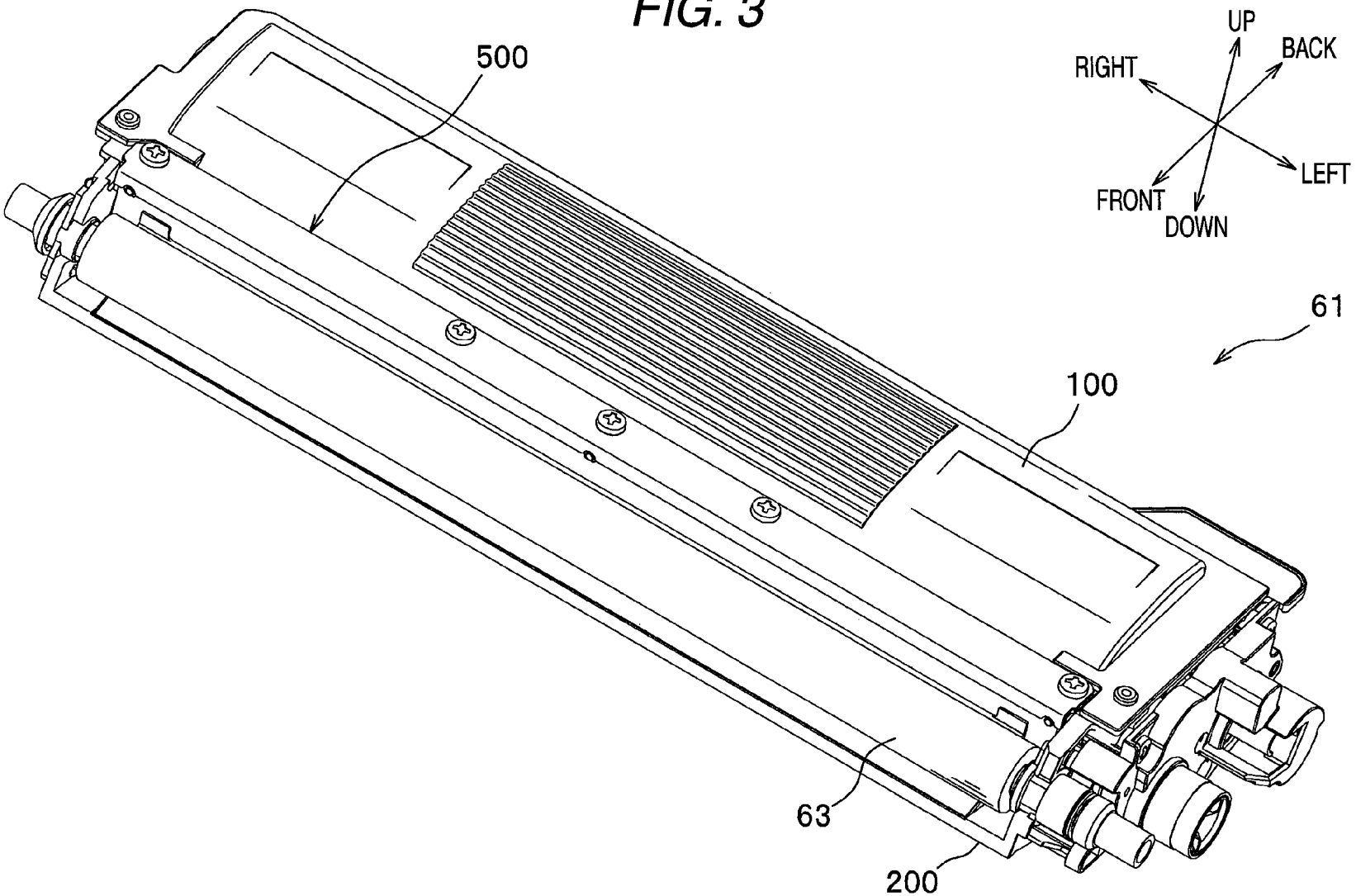
FIG. 3 is a perspective view of a developing cartridge.

In the following descriptions, directions will be explained by reference to the directions achieved when the developing cartridge 61 is oriented sideways as shown in FIG. 3. Specifically, in FIG. 3, a side where the blade assembly 500 is to be positioned is taken as an "upside"; a side opposite to the upside is taken as a "downside"; a side where the developing roller 63 of the developing cartridge 61 is to be positioned is taken as the "front side"; and a side opposite to the front side is taken as a "rear side." Moreover, a right-left direction is determined by defining up-down and front-back directions.

Figure 4:
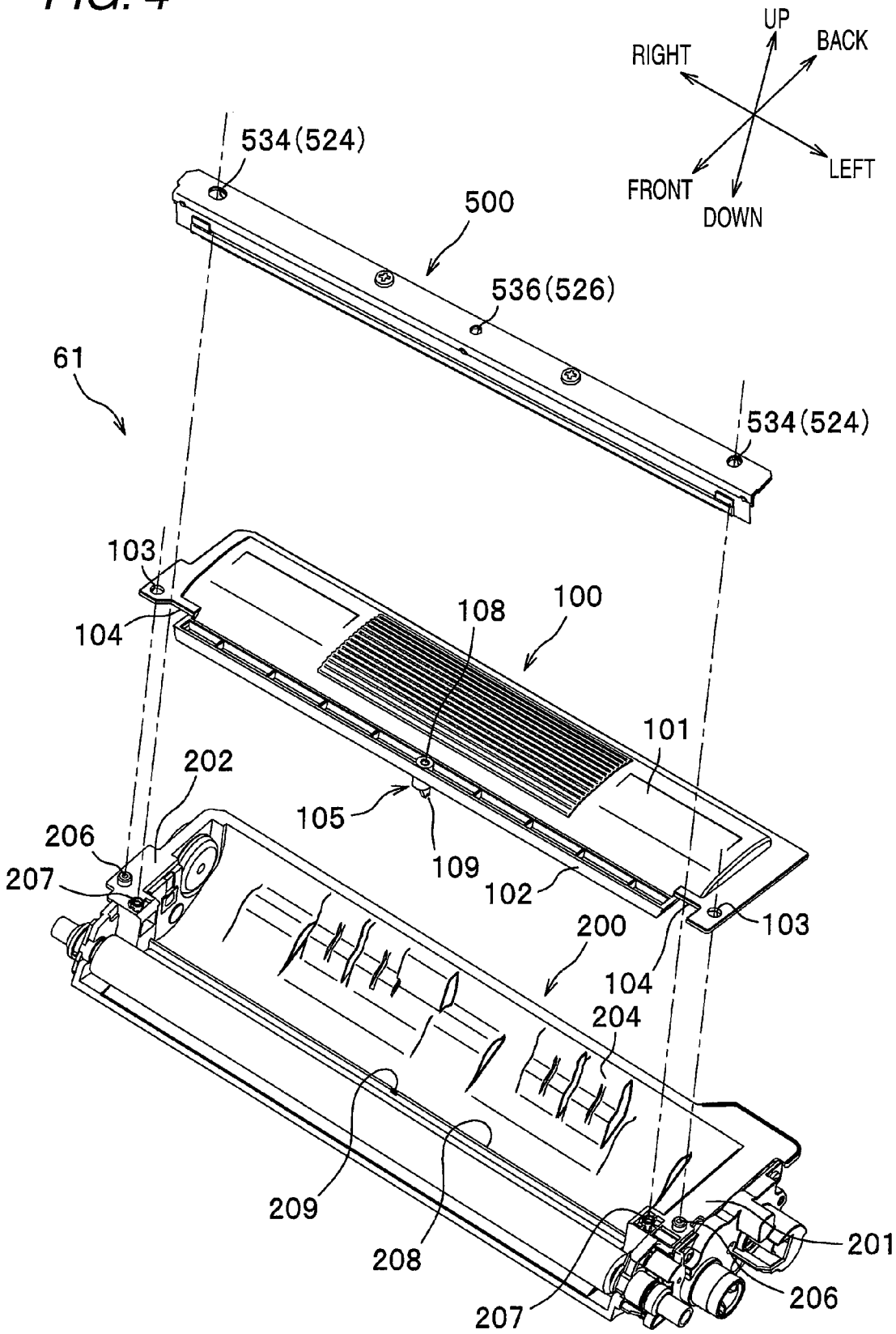
FIG. 4 is an exploded perspective view of the developing cartridge.

As shown in FIGS. 3 and 4, the developing cartridge 61 includes an upper frame 100 as an example of a first frame, a lower frame 200 as an example of a second frame, and the blade assembly 500.

The upper frame 100 includes a main body portion 101 and a beam 102 as an example of a first wall portion. The main body portion has a plate shape. The beam 102 downwardly projects from a front end of the main body 101. One boss hole 103 as an example indentation positions the upper frame 100 with respect to a lower frame 200 (described later) upon engagement with a boss 206 of the lower frame 200. The boss hole 103 is formed on a front end of each of the right and left side portions of the main body 101. A recess 104, which rearwardly recedes to create clearance between the beam and a mount boss 207 of the lower frame 200 (described later), is formed between the beam 102 and respective areas where the respective boss holes 103 are to be formed.

Figure 5:
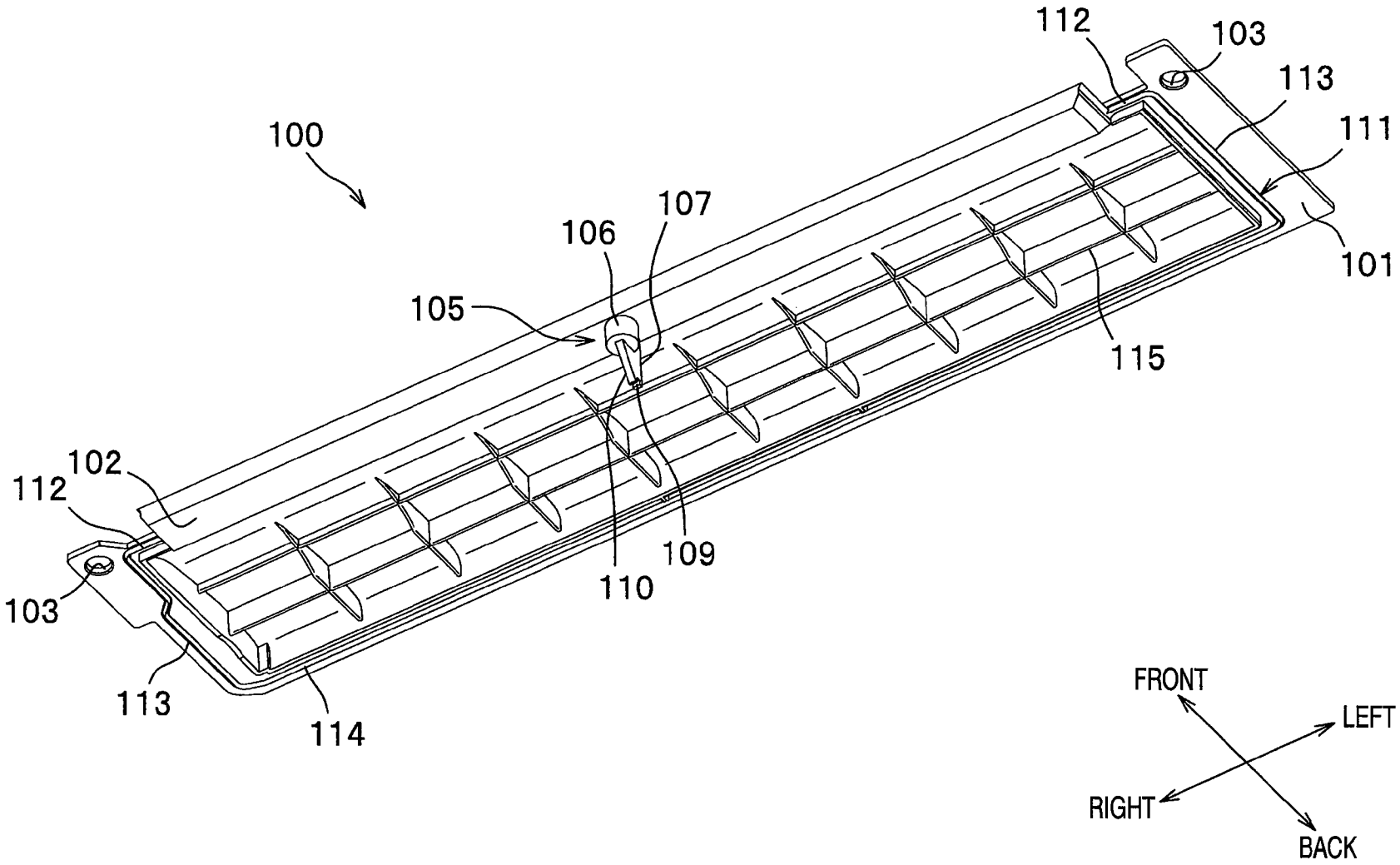
FIG. 5 is a perspective view of an upper frame of the developing cartridge when viewed from below.

As shown in FIG. 5, a support 105 projecting in a downward direction (i.e., toward the lower frame 200) is formed at a center portion of a lower surface of the beam 102. The support 105 includes a base 106 and an engagement piece 107. The base 106 is formed integrally with the beam 102. The engagement piece 107 downwardly projects from a lower end of the base 106.

The base 106 is formed to have a columnar shape. A bottom surface of a screw mount hole 108 (see FIG. 4), which is formed downwardly from an upper surface of the beam 102, is positioned in the base 106. A tapped hole whose inner peripheral surface has a thread groove may be the screw mount hole 108. Alternatively, a hole having a cylindrical face in which a thread groove is tapped by a screw when the screw is attached may also be the screw mount hole.

The engagement piece 107 is formed to have a tapered shape which substantially appears to be triangular when viewed from the side. An engagement groove 109 is provide data distal end of the engagement piece 107. The engagement groove 109 is engaged with an engagement groove 209 (see FIG. 4) of a partition wall 208 of the lower frame 200 (described later). The engagement piece 107 is formed to have a triangular shape with a tapered face 110 that is rearwardly inclined with an increasing distance in the downward direction. Accordingly, when compared with a case where the engagement piece is formed to simply have a rectangular shape, a front portion of the engagement piece is caused to recede rearwardly. Therefore, even when the upper frame 100 is attached to the lower frame 200, occurrence of interference of the supply rollers 64 attached to the lower frame 200 with the engagement piece 107 can be prevented.

A weld rib 111 as an example of a weld portion is formed along a circumference of a lower surface of the main body 101 of the upper frame 100. The weld rib 111 is welded to upper surfaces 205 (see FIG. 6) of a left sidewall 201, a right sidewall 202, and a rear sidewall 204 of the lower frame 200 (described later). The weld rib 111 includes first ribs 112, second ribs 113 and a third rib 114. The first ribs 112 extend to the outside from both ends of the beam 102 in the right-left direction. The second ribs 113 rearwardly extend from outer ends of the respective first ribs 112 in the right-left direction. The third rib 114 extends in the right-left direction so as to connect rear ends of the respective second ribs 113.

A plurality of reinforcement ribs 115 extending in the front-back and left-right directions are provided at a center area of the lower surface of the main body 101 of the upper frame 100.

Figure 6:
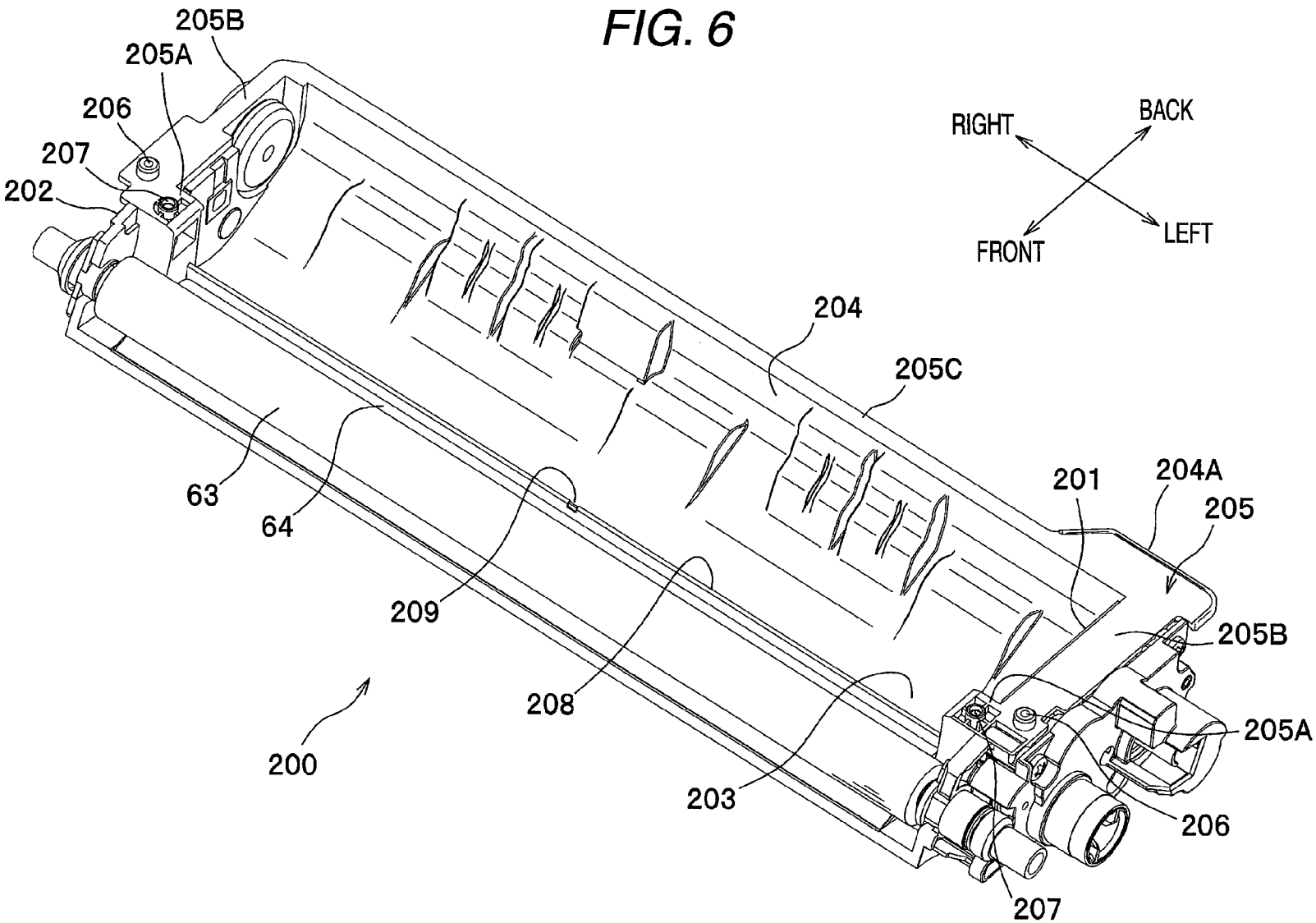
FIG. 6 is a perspective view of a lower frame of the developing cartridge.

As shown in FIG. 6, the lower frame 200 includes the left sidewall 201, the right sidewall 202, a bottom wall 203 and the rear sidewall 204. The left sidewall 201 and the right sidewall 202 serve as an example of a second wall. The bottom wall 203 and the rear sidewall 204 serve as an example of a third wall. By combination of the lower frame 200 with the upper frame 100, an opening 300 (see FIG. 7) is formed from the left sidewall 201, the right sidewall 202, and the bottom wall 203 of the lower frame 200 and the beam 102 of the upper frame 100.

The left sidewall 201 and the right sidewall 202 oppose each other in the right-left direction. Lower ends of the left sidewall 201 and the right sidewall 202 are connected together by the bottom wall 203. Rear ends of the left sidewall 201, the right sidewall 202, and the bottom wall 203 are joined together by the rear sidewall 204. The upper surfaces 205 of the left sidewall 201, the right sidewall 202, and the rear sidewall 204, all of which are joined together, are formed as a single plane. In the exemplary embodiment, the upper surfaces 205 of the left sidewall 201, the right sidewall 202, and the rear sidewall 204 are formed as a single plane surface.

The upper surfaces 205 are built from first upper surfaces 205A, second supper surfaces 205B and a third upper surface 205C. The first upper surfaces 205A inwardly protrude from interior surfaces of the left sidewall 201 and the right sidewall 202. The second upper surfaces 205B form the upper surface of the left sidewall 201 and the upper surface of the right sidewall 202. The third upper surface 205C forms an upper surface of the rear sidewall 204. Front areas of the first upper surfaces 205A are utilized as fixed parts where both ends of the blade assembly 500 (described later) are fixed. The second upper surfaces 205B, the third upper surface 205C, and rear ends of the first upper surfaces 205A are utilized as weld parts where the upper frame 100 is to be welded. That is, the fixed parts where both ends of the blade assembly 500 are to be fixed and the weld parts where the upper framed 100 is to be welded are provided on a single plane.

Figure 7:
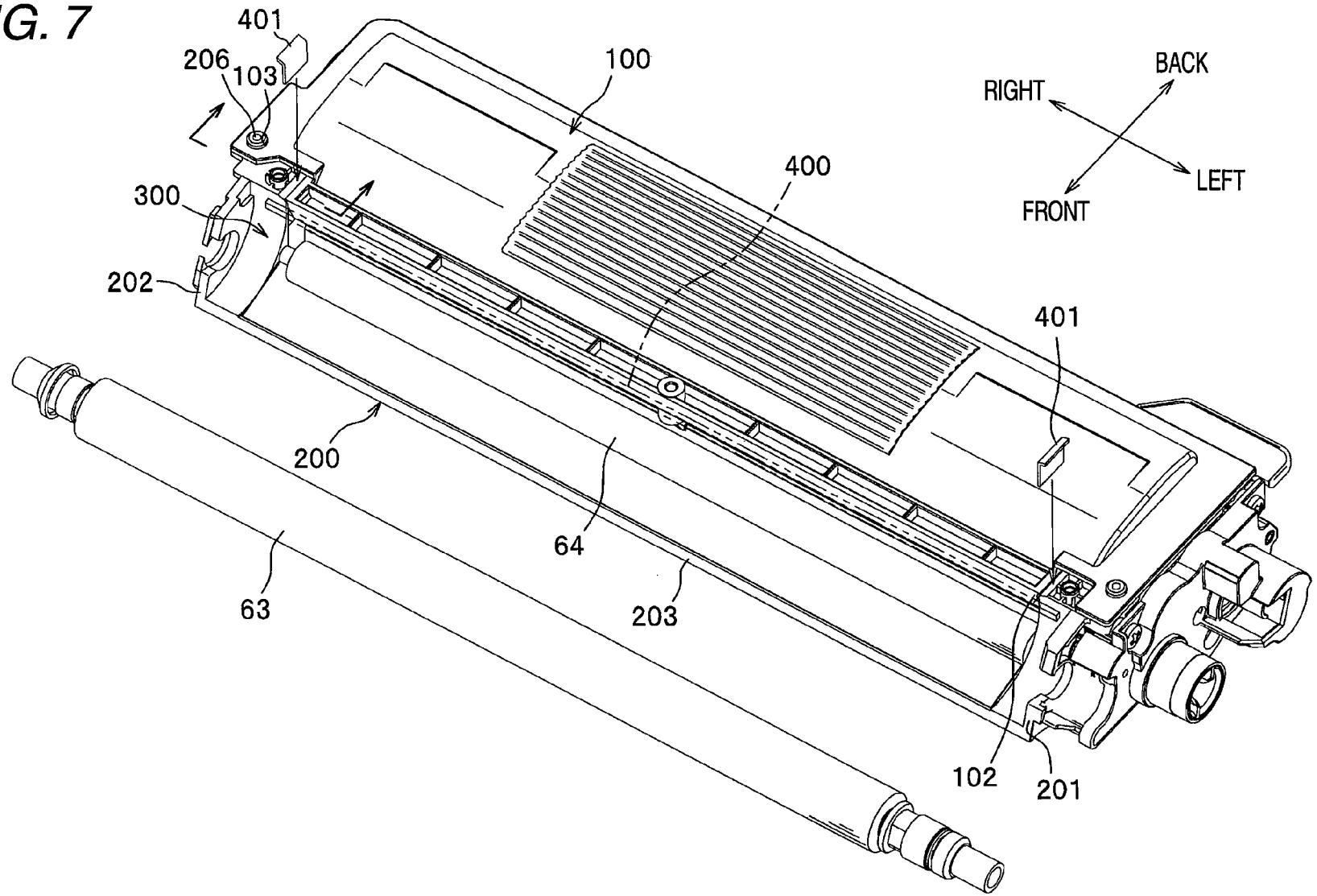
FIG. 7 is a schematic perspective view of the developing cartridge showing a state where seal members are joined to the upper frame and the lower frame.

A boss 206 for positioning the upper frame 100 with respect to the lower frame 200 is formed one in each of the front portions of the respective second upper surfaces 205B, namely, each of the areas of the upper surfaces 205 facing the opening 300 (see FIG. 7). The boss 206 serves as an example of a protrusion. Further, a cylindrical closed-end mount boss 207 for mounting the blade assembly 500 is formed one on each of the first upper surfaces 205A. A tapped hole whose internal peripheral surface has a screw thread may be the hole formed in the mount boss 207. Alternatively, a hole having a cylindrical surface in which a screw thread is to be tapped when a screw is attached to the hole may also be the hole formed in the mount boss 207.

A partition wall 208 is formed in a substantially center area of the bottom wall 203 in a longitudinal direction thereof so as to protrude upwardly. According thereto, a space sandwiched between the upper frame 100 and the lower frame 200 is separated into a space facing the opening 300 (see FIG. 7) and a space on the other side of the opening 300. An engagement groove 209 is formed at a substantially center area of the distal end of the partition wall 208. The engagement groove 209 is engaged with the engagement groove 109 formed at the distal end of the support 105 of the upper frame 100. According thereto, the beam 102 of the upper frame 100 is supported by the bottom wall 203 by way of the support 105 and the partition wall 208.

The supply roller 64 is provided adjacent to the front side of the partition wall 208. The developing roller 63 is adjacent to the upper front side of the supply roller 64. According thereto, the developing roller 63 becomes exposed outside of the opening 300 shown in FIG. 7.

As shown in FIG. 6, a grip 204A to be gripped by a user is formed at a left upper part of the rear sidewall 204. The grip enables effective utilization of a rear center space of the developing cartridge 61 when compared with a structure in which the grip is provided at a center area of the rear sidewall.

As shown in FIG. 7, when the upper frame 100 is attached to the lower frame 200, a front surface of the beam 102 of the upper frame 100 and portions of front surfaces of the left sidewall 201 and the right sidewall 202 of the lower frame 200 are provided on a substantially single plane. A long first seal member 400 extending in the right-left direction is joined, in a straddling manner, to the front surface of the beam 102 and the portions of the front surfaces of the left sidewall 201 and the right sidewall 202 which are provided on the substantially single plane. The first seal member 400 may be formed from a soft material, such as sponge and felt.

Figure 8A:
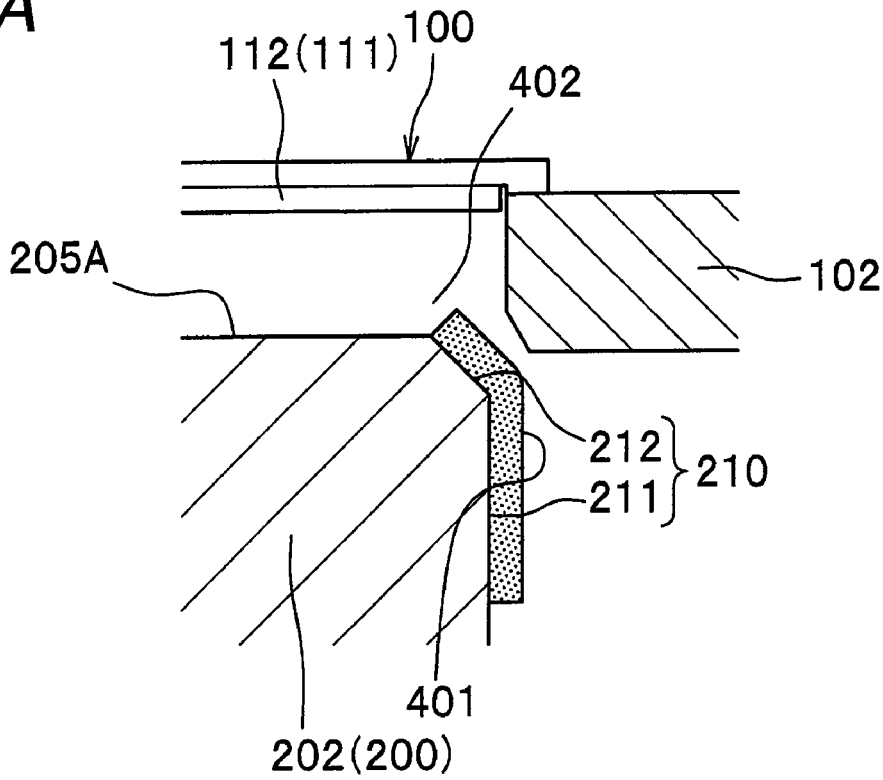
FIG. 8A is a cross-sectional view taken along a line VIII-VIII in FIG. 7.

Sheet-shaped second seal members 401 formed from the same material as that of the first seal member 400 are interposed between right and left end faces of the beam 102 of the upper frame 100 and interior surfaces of the left sidewall 201 and the right sidewall 202 of the lower frame 202. As shown in FIG. 8A, the second seal members 401 are joined to the lower frame 200. A method for joining the second seal member 401 to the right sidewall 202 of the lower frame 200 will be described in detail below. In contrast, since the method is also applied to the left sidewall 201, explanation for the left sidewall 202 is omitted.

As shown in FIG. 8A, an interior surface 210 of a portion of the right sidewall 202 whose upper surface serves as the first upper surface 205A includes a plane 211 and a slope surface 212. The plane 211 stretches along the vertical direction. The slope surface 212 is inclined toward the outside along the right-left direction with an upward increasing distance from the upper end of the plane 211. The second seal member 401 is joined so as to extend along the slope surface 212 and the plane 211.

Figure 8B:
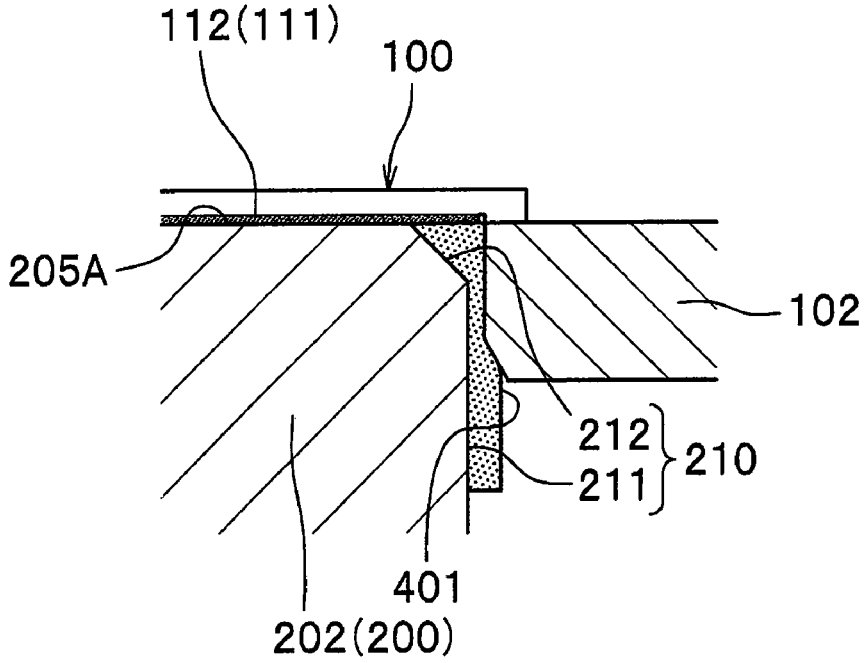
FIG. 8B is a cross-sectional view showing a state where the seal member and a weld rib are welded together in FIG. 8A.

As shown in FIG. 8B, a portion of the second seal member 401 joined to the plane 211 is sandwiched between the beam 102 of the upper frame 100 and the plane 211 when the upper frame 100 is attached to the lower frame 200. An upper end 402 of the second seal member 401 is collapsed by the weld rib 111 (i.e., the first rib 112) of the upper frame 100 and subsequently welded together with the weld rib 111.

Figure 9:
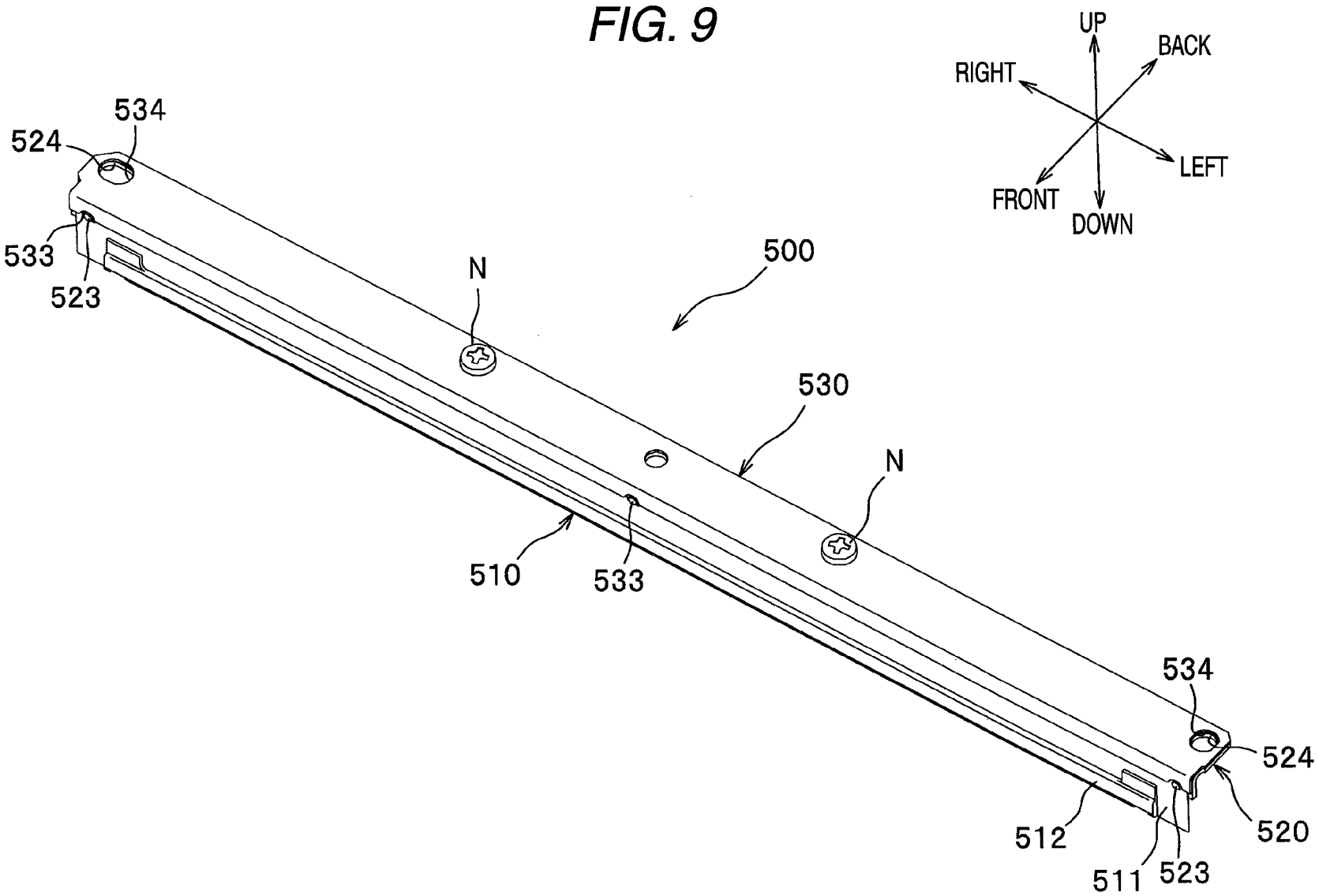
FIG. 9 is a perspective view of a blade assembly of the developing cartridge.
Figure 10:
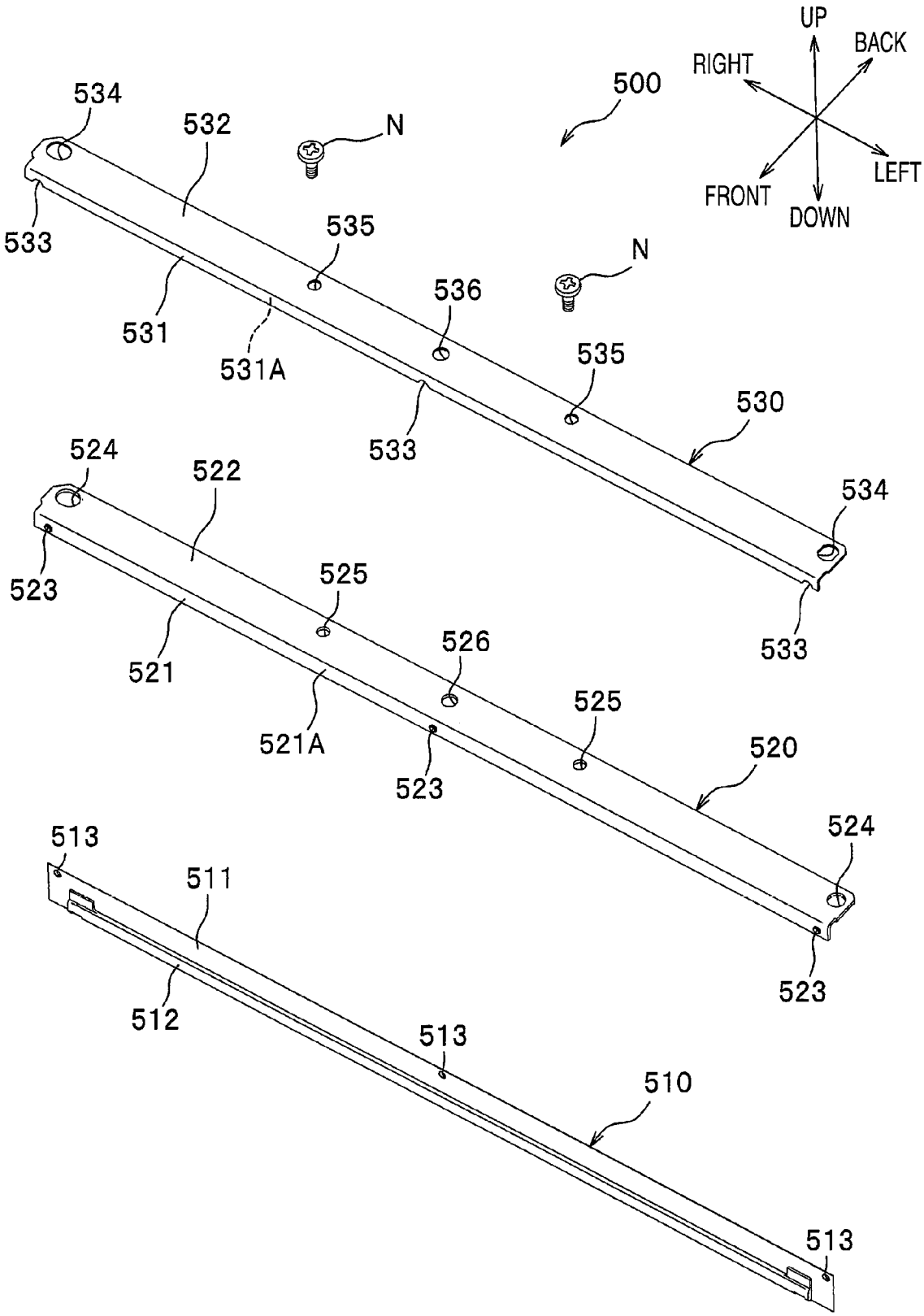
FIG. 10 is an exploded perspective view of the blade assembly.

As shown in FIGS. 9 and 10, the blade assembly 500 includes a layer thickness regulation blade 510, a blade holder 520, and a blade reinforcement plate 530.

The layer thickness regulation blade 510 includes a plate-shaped member 511 and a press member 512 provided at a distal end side (i.e., a lower end side) of the plate-shaped member 511. The plate-shaped member 511 is formed from a rectangular, thin metal plate. The plate-shaped member 511 exhibits flexibility and generates pressing force toward the developing roller 63. The press member 512 is a rubber-like member. The press member 512 is formed to have a cross section that protrudes toward the developing roller 63 (see FIG. 11A). The protruding portion of the press member directly makes a slidable contact with the developing roller 63 so as to regulate the thickness of the developer held on the surface of the developing roller 63.

A positioning opening 513 is formed on a base end side (i.e., an upper end side) of the plate-shaped member 511 in correspondence with a projection 523 of the blade holder 520 (described later). There are formed three positioning openings 513, two of which is formed at both longitudinal ends of the plate-shaped member 511 (i.e., in an axial direction of the developing roller 63), and one of which is formed at a center area of the same.

Figure 11B:
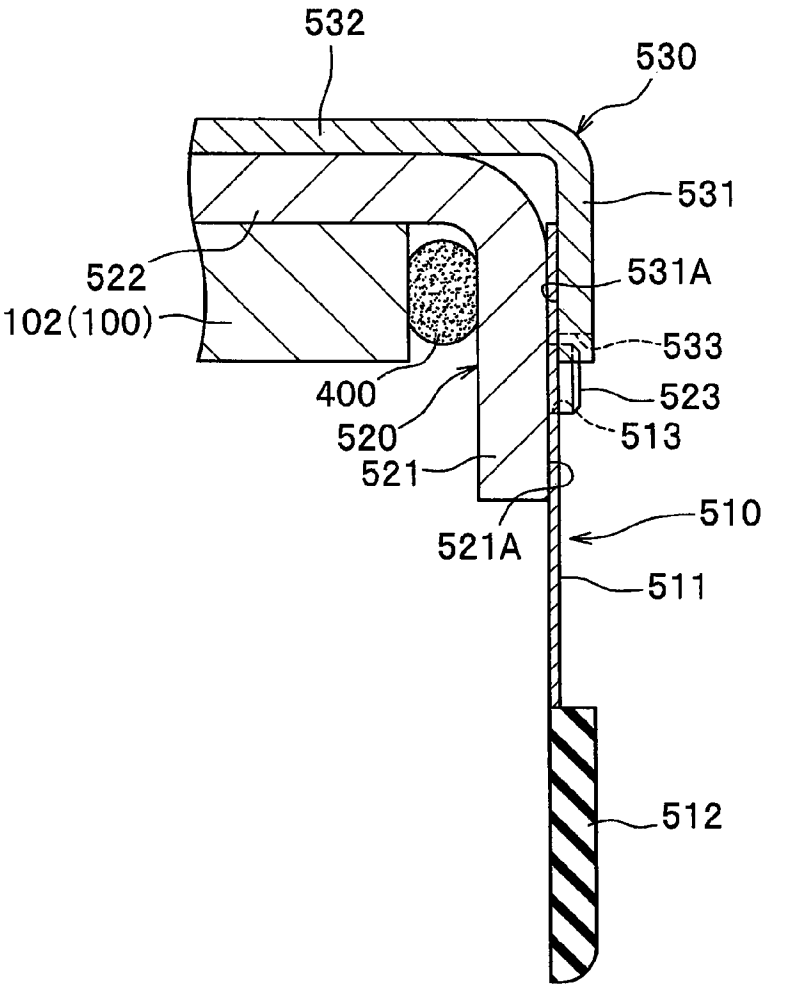
FIG. 11B is a cross-sectional view showing a cross section taken by cutting a center portion of the blade assembly.
Figure 11A:
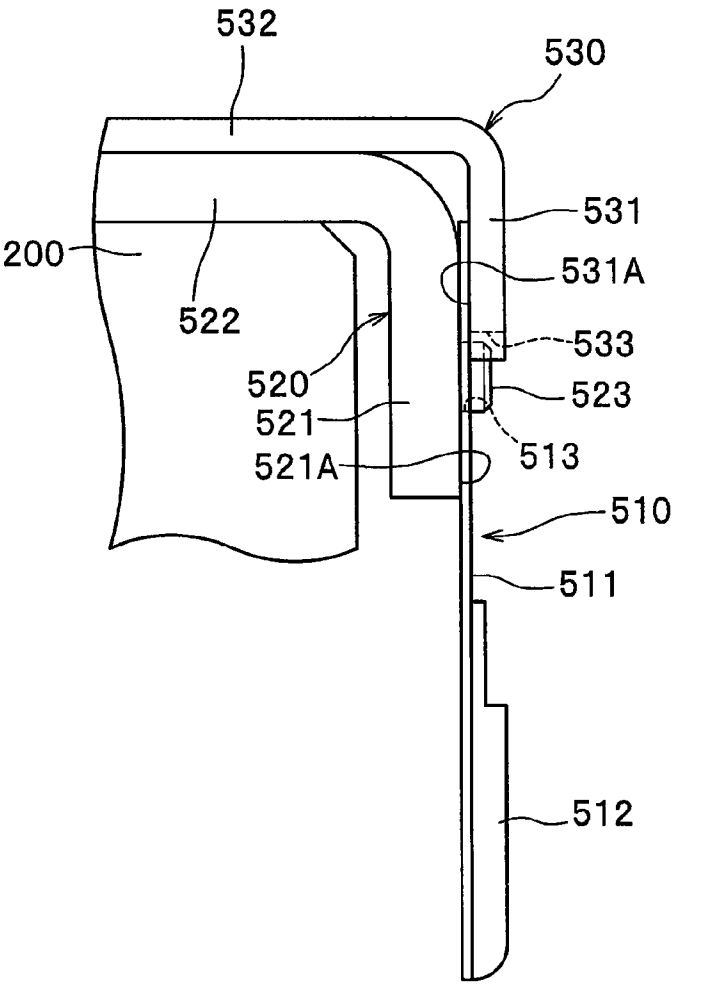
FIG. 11A is a side view of the blade assembly.

The blade holder 520 is produced by bending a plate-shaped metal member at substantially right angles (see FIG. 11A). The blade holder 520 includes a nip portion 521 and a mount portion 522. The nip portion as an example of a first plate-shaped portion extends in the vertical direction. The mount portion 522 as an example of a second plate-shaped portion extends in a direction substantially perpendicular to the nip portion 521.

The nip portion 521 nips the layer thickness regulation blade 510 (i.e., the plate-shaped member 511) between the nip portion 521 and the blade reinforcement plate 530 (described later). An outer face (i.e., a front face) of the nip portion 521 as a contact surface 521A contacts the layer thickness regulation blade 510. A protrusion 523 to be fitted into the positioning opening 513 of the layer thickness regulation blade 510 is formed on the contact surface 521A. There are formed three protrusions 523, one of which is formed at a longitudinal center area of the contact surface 521A, and two of which are formed at longitudinal both ends of the contact surface 521A.

The mount portion 522 is an area whose both ends of an inner surface (i.e., a lower surface) are brought into contact with and attached to the lower frame 200. The mount portion 522 is formed to have a plane shape along the upper surface 205 (i.e., the first upper surface 205A) of the lower frame 200. Mount holes 524 for fastening the blade holder to the lower frame 200 are formed one at each end of the mount portion 522. The right mount hole 524 is formed to have an elongated hole extended in the longitudinal direction. The left mount hole 524 is formed to have a complete round shape.

A pair of screw mount holes 525 for fixing the blade holder 520 and the blade reinforcement plate 530 to each other are formed between the pair of mount holes 524. A tapped hole whose inner peripheral surface has a thread groove may be the screw mount holes 525. Alternatively, a hole having a cylindrical face in which a thread groove is tapped by a screw when the screw is attached may also be the screw mount holes. The pair of screw mount holes 525 and the pair of mount holes 524 are provided at substantially uniform intervals in the longitudinal direction of the mount hole 522.

An insert hole 526 is formed between the pair of screw mount holes 525. The insert hole 526 coincides with the screw mount hole 108 that is formed in the beam 102 of the upper frame 100.

The blade reinforcement plate 530 is made by folding a plate-shaped metal member at substantially right angles (see FIG. 11A). The blade reinforcement plate 530 is built from a nip portion 531 stretching in the vertical direction and a mount portion 532 extending in a direction substantially perpendicular to the nip portion 531.

The nip portion 531 nips the layer thickness regulation blade 510 (i.e., the plate-shaped member 511) between the nip portion 531 and the nip portion 521 of the blade holder 520. An inner surface (i.e., a rear surface) of the nip portion 531 acts as a contact surface 531A that contacts the layer thickness regulation blade 510. Substantially semicircular cutouts 533 are formed at a lower end of the nip portion 531 so as to avoid the respective protrusions 523 formed on the contact surface 521A of the blade holder 520. There are formed three cutouts 533, two of which are formed at both longitudinal ends of a lower end of the nip portion 531, and one of which is formed at a center area of the nip portion 531.

An inner surface (i.e., a lower surface) of the mount portion 532 is arranged so as to contact the mount portion 522 of the blade holder 520. The mount portion 532 includes a pair of mount holes 534, a pair of insert holes 535 and an insert hole 536. The pair of mount holes 534 is formed in correspondence with the pair of mount holes 524 of the blade holder 520. The pair of insert holds 535 are formed at the same locations in the vertical direction where the pair of screw mount holes 525 of the blade holder 520 is provided. Each one of the pair of insert holes 535 has the same shape as the respective one of the screw mount hole 525 when viewed from above. An insert hole 536 is formed in the same manner as that of the insert hole 526 of the blade holder 520 in terms of a location and a shape.

The right mount hole 534 is formed in the same fashion as is the right mount hole 524 of the blade holder 520 in terms of a location and a shape. The left mount hole 534 is formed to have an elongated shape extended in the longitudinal direction.

Screws N are screwed and inserted into the screw mount holes 525 of the blade holder 520 from the blade reinforcement plate 530 while the layer thickness regulation blade 510 is sandwiched between the nip portion 521 of the blade holder 520 and the nip portion 531 of the blade reinforcement plate 530. Accordingly, the blade assembly 500 is assembled. At this time, since the left mount hole 534 of the blade reinforcement plate 530 is formed to have the shape of an elongated hole extended in the longitudinal direction, a bend error of the blade reinforcement plate 530 can be absorbed by the mount hole 534. The word "bend error" used herein signifies an error between a target value and an actual value as in a case where a value of 89° is actually acquired despite an attempt to bend a plate material at an angle of 90°.

As shown in FIG. 4, the pair of mount holes 524 and 534 formed at both ends of the blade assembly 500 is fastened by screws (not shown) to a pair of mount bosses 207. The pair of mount bosses is formed on the respective first upper surfaces 205A of the left sidewall 201 and the right sidewall 202 of the lower frame 200. At this time, since the right mount holes 524 and 534 of the blade assembly 500 have the shape of an elongated hole extended in the right-left direction, thermal expansion and contraction of the lower frame 200 in the right-left direction can be absorbed by the right mount holes 524 and 534.

Thus, in a state where the blade assembly 500 is secured to the lower frame 200, the beam 102 of the upper frame 100 is provided below the respective mount portions 522 and 532 of the blade assembly 500, and a portion of the blade assembly 500 facing the layer thickness regulation blade 510 is provided between the beam 102 and the developing roller 63, as shown in FIG. 11B. In this state, the first seal member 400 is sandwiched between the nip portion 521 of the blade holder 520 and the beam 102 of the upper frame 100. A gap between the blade assembly 500 and the beam 102 is closed by the first seal member 400.

Further, as shown in FIG. 4, screws (not shown) are inserted into the insert holes 526 and 536 formed in the center area of the blade assembly 500 whose both ends are secured to the lower frame 200. The screws are screwed into the screw mount holes 108 opened in the beam 102 of the upper frame 100 and the beam 102 is fastened to the blade assembly 500. Accordingly, the blade assembly 500 can be reinforced.

Next, a method for assembling the developing cartridge 61 will be described.

As shown in FIG. 7, the sheet-shaped second seal member 401 is joined to the left sidewall 201 and the right sidewall 202 of the lower frame 200 (see FIG. 8A).

Subsequently, the boss holes 103 of the upper frame 100 are fitted to the bosses 206 of the lower frame 200 for positioning the upper frame 100 with respect to the lower frame 200. At this time, since the boss 206 is formed on both the left sidewall 201 and the right sidewall 202 of the lower frame 200, the left sidewall 201 and the right sidewall 202 are reinforced by the upper frame 100 while the upper frame 100 is temporarily attached to the lower frame 200 by way of the boss 206, or the like.

Further, as shown in FIG. 4, the engagement groove 109 provided on the distal end of the support 105 formed on the beam 102 of the upper frame 100 is engaged with the engagement groove 209 provided on the distal end of the partition wall 208 of the lower frame 200. Accordingly, the beam 102 of the upper frame 100 is supported by the lower frame 200.

Subsequently, the weld rib 111 of the upper frame 100 (see FIG. 5) is welded so as to fasten the upper frame 100 to the lower frame 200. As described previously, the left sidewall 201 and the right sidewall 202 of the lower frame 200 are reinforced by the upper frame 100 during welding operation. Thus, a deviation between the upper frame 100 and the lower frame 200 can be prevented. As shown in FIG. 8B, the second seal member 401 joined to the left sidewall 201 and the right sidewall 202 of the lower frame 200 are welded with the weld rib 111 at the time of welding operation.

As shown in FIG. 7, the supply roller 64 is attached to the lower frame 200 after welding operation. Subsequently, seal members are positioned at locations in the lower frame 200 corresponding to both ends of the developing roller 63, and the developing roller 63 is attached to the lower frame 200.

The first seal member 400 is subsequently joined so as to extend across left sidewall 201, the right sidewall 202 of the lower frame 200, and the beam 102 of the upper frame 100. As shown in FIG. 4, the mount holes 524, 534 of the blade assembly 500 are attached to the mount bosses 207 of the lower frame 200. Both ends of the blade assembly 500 are secured to the left sidewall 201 and the right sidewall 202 of the lower frame 200 by screws (not shown).

Then, the screws (not shown) are inserted into the insert holes 526 and 536 of the blade assembly 500 and are screwed into the screw mount holes 108 opened in the beam 102 of the upper frame 100. Accordingly, the developing cartridge 61 can be assembled. The assembled developing cartridge 61 is arranged in numbers along a direction in which the upper frame 3100 and the lower frame 200 oppose each other (see FIG. 1).

According to the exemplary embodiments of the invention, the beam 102 is formed integrally on the front end of the upper frame 100, the front end of the upper frame 100 is supported by the bottom wall 203 of the lower frame 200 by way of the support 105 and the partition wall 208. Therefore, the rigidity of the front end of the upper frame 100 can be enhanced.

According to the exemplary embodiments of the invention, the seal member 400 is interposed between the beam 102 and the blade assembly 500. Herein, the rigidity of the front end of the upper frame 100 (i.e., the beam 102) is enhanced as described above. Therefore, warping of the seal member 400 can be prevented. Accordingly, leakage of developer, which would otherwise arise in the gap between the blade assembly 500 and the beam 102, can also be prevented.

According to the exemplary embodiments of the invention, the support 105 downwardly protruding from the beam 102 of the upper frame 100 is engaged with the partition wall 208 upwardly protruding from the bottom wall 203 of the lower frame 200. Therefore, the length of the support can be reduced when compared with the case where the upper frame is supported by, for example, a protrusion formed from the beam to the bottom wall of the lower frame. Accordingly, rigidity of the support can be enhanced.

According to the exemplary embodiments of the invention, the mount portions 522 and 532 of the blade assembly 500 are positioned along the upper surface of the beam 102 of the upper frame 100. Therefore, the beam 102 can be protected by the mount portions 522 and 532. Accordingly, infliction of damage to the support 105 formed on the beam 102, which would otherwise be caused by force applied from above, can be prevented.

According to the exemplary embodiments of the invention, both ends of the blade assembly 500 are secured to the left sidewall 201 and the right sidewall 202 of the lower frame 200. Therefore, the left sidewall 201 and the right sidewall 202 are joined together by the blade assembly 500. Accordingly, the rigidity of the lower frame 200 can be enhanced.

According to the exemplary embodiments of the invention, both ends of the mount portions 522 and 532 of the blade assembly 500 are secured on the upper surfaces 205 of the left sidewall 201 and the right sidewall 202 of the lower frame 200. Therefore, a joint area between the left sidewall 201, the right sidewall 202 and the first seal member 400 can be increased when compared with the structure in which the nip portions 521 and 531 of the blade assembly 500 are fixed to the front surfaces of the left sidewall 201 and the right sidewall 202 (see FIG. 7). Accordingly, the bonding strength achieved between the first seal member 400 and the lower frame 200 can be enhanced.

In the structure in which both ends of the mount portions 522 and 532 of the blade assembly 500 are secured on the upper surfaces 205 of the lower frame 200, the vertical lengths of the nip portions 521, 531 of the blade assembly 500 and the vertical length of the beam 102 can be shortened. Therefore, the size of the developing cartridge 61 can be reduced in the direction in which the upper frame 100 and the lower frame 200 oppose each other. For example, in a structure in which seal members are positioned on the base ends of the nip portions 521 and 531 of the blade assembly 500 and which the extremities of the nip portions 521 and 531 are fastened to the front surface of the lower frame 200 by screws, the lengths of the nip portions 521 and 531 and the length of the beam 102 become longer by an amount corresponding to the length of an area to be screwed when compared with the embodiment.

The size of the developing cartridge 61 can be reduced in a direction where the upper frame 100 and the lower frame 200 oppose each other (i.e., an opposing direction) is arranged in numbers along the opposing direction. Therefore, the size of the image forming apparatus 1 can be reduced in the opposing direction.

According to the exemplary embodiments of the invention, the first seal member 400 is joined so as to extend across the left sidewall 201 and the right sidewall 202 of the lower frame 200 and the beam 102 of the upper frame 100. Therefore, leakage of developer, which would otherwise arise in the gap between the left sidewall 201 and the right sidewall 202 of the lower frame 200 and the beam 102 of the upper frame 100, can be prevented.

According to the exemplary embodiments of the invention, the boss holes 103 and bosses 206 are formed at the front ends (i.e., the areas close to the opening 300) of the upper frame 100 and the lower frame 200. Therefore, the joint face between the beam 102 provided on the front end side and the first seal member 400 and the joint face between the left sidewall 201 and the right sidewall 202 of the lower frame 200 and the first seal member 400 can be positioned with superior accuracy. As a result of the boss holes 103 being engaged with the bosses 206, the left sidewall 201 and the right sidewall 202 of the lower frame 200 are reinforced by the upper frame 100. Therefore, deviation between the upper frame 100 and the lower frame 200, which would otherwise arise during welding operation, can be prevented, and superior welding can be performed.

According to the exemplary embodiments of the invention, the first rib 112 provided at the front end (i.e., the area close to the opening 300) of the weld rib 111 is welded together with the second seal member 401. Therefore, leakage of developer, which would otherwise arise in the gap between the left sidewall 201 and the upper surface 205 of the right sidewall 202 of the lower frame 200 and the upper frame 100, can be prevented.

According to the exemplary embodiments of the invention, the beam 102 of the upper frame 100 is fastened to the blade assembly 500 by screws. Therefore, the rigidity of the front end of the upper frame 100 can be enhanced.

According to the exemplary embodiments of the invention, a fixed portion where both ends of the blade assembly 500 are to be fixed and the welded portion where the upper frame 100 is to be welded are provided within a single plane (i.e., the upper surfaces 205). Therefore, when compared with a structure in which the fixed portion and the welded portion are provided on different surfaces in a stepped manner, the structure can be simplified.

According to the exemplary embodiments of the invention, the engagement groove 109 formed at the distal end of the support 105 is engaged with the engagement groove 209 formed at the center area along the distal end of the partition wall 208. Therefore, movements of the support 105 in the front-back direction and the right-left direction, which would otherwise be caused when the support 105 is engaged with the partition wall 208, are regulated by the engagement grooves 109 and 209. Accordingly, removal of the support 105 from the partition wall 208 is prevented.

The present invention is not limited to the embodiment and can be utilized in various modes as exemplified below.

In the above-described exemplary embodiments, while the color printer has been illustrated as an example of an image forming apparatus, the present inventive concept may alternatively be applied to any devices including, for example, a copier and a multifunction device.

In the above-described exemplary embodiments, the support 105 projecting from the beam 102 is engaged with the partition wall 208 projecting from the bottom wall 203 of the lower frame 200. However, the present invention is not limited to the structure as long as the support is interposed between the beam of the upper frame and the bottom wall of the lower frame. For example, the center area of the partition wall 208 of the present embodiment can also be projected further upward, and the beam 102 can be supported by the projected area. In addition, a projection from the beam 102 can also be brought into contact with the bottom wall 203 of the lower frame 200.

In the above-described exemplary embodiments, the boss holes 103 serving as recesses are formed in the upper frame 100, and the bosses 206 serving as protrusions are formed on the lower frame 200. Alternatively, the protrusions can also be formed on the upper frame, and the recesses can also be formed in the lower frame.

In the above-described exemplary embodiments, the beam 102 is fastened to the blade assembly 500 by the screws. Alternatively, the beam can also be not fastened.

In the above-described exemplary embodiments, the support 105 is provided in number of one in the present embodiment. Alternatively, the support 105 can also be provided in numbers.

In the above-described exemplary embodiments, the developing cartridges are arranged so as to extend in an oblique upward direction within the main unit of the printer in the present embodiment. Alternatively, the developing cartridges can also be arranged so as to extend horizontally.

Further, the vertical positions of the upper frame and the lower frame can also be inverted.

In the above-described exemplary embodiments, the photosensitive members are exposed by the LED unit. Alternatively, there can also be adopted a configuration in which the photosensitive members are exposed by a laser scanner.

In the above-described exemplary embodiments, a printer of so-called direct tandem type is adopted as the image forming apparatus. Alternatively, an intermediate transfer tandem-type printer, a four cycle type-printer, and a monochrome printer can also be adopted.

According to another illustrative aspects of the invention, the developing cartridge further comprises: a developer carrier that is exposed to the opening; a layer thickness regulation member, which is provided between the developer carrier and the first wall so as to regulate thickness of a developer on the developer carrier; and a first seal member that closes a gap between the layer thickness regulation member and the first wall.

According to still another illustrative aspects of the invention, the developing cartridge further comprises: a partition wall that protrudes from the second frame toward the first frame so as to partition a space between the first frame and the second frame, wherein the support protrudes from the first wall toward the second frame so as to engage with a distal end of the partition wall.

According to still another illustrative aspects of the invention, the layer thickness regulation member comprises: a first plate-shaped portion that nips the first seal member between the first plate-shaped portion and the first wall; and a second plate-shaped portion that is bent from the first plate-shaped portion so as to extend along a surface of the first frame opposite to the second frame.

According to still another illustrative aspects of the invention, both ends of the layer thickness regulation member are secured to the pair of second walls.

According to still another illustrative aspects of the invention, both ends of the second plate-shaped portion are secured to the pair of second walls.

According to still another illustrative aspect of the invention, the first seal member extends across the pair of second walls and the first wall.

According to still another illustrative aspects of the invention, the developing cartridge further comprises: a recess that is formed in one of the first frame and the pair of second walls at a side closed to the opening; and a protrusion that is formed on another one of the first frame and the pair of second walls at a side closed to the opening, wherein the recess and the protrusion are engaged so as to position the first frame and the second frame.

According to still another illustrative aspects of the invention, the developing cartridge further comprises: a weld portion, which is provided on the first frame at a side facing the second frame, and which is welded to end faces of the pair of second walls; and a second seal member, which is provided on the pair of second walls, and which is welded to the weld portion at a side close to the opening.

According to still another illustrative aspect of the invention, the first wall is secured to the layer thickness regulation member.

According to still another illustrative aspect of the invention, the pair of second walls comprises: a fixed portion, to which the second plate-shaped portion is secured; and a welded portion, to which the first frame is welded, wherein the fixed portion and the welded portion are provided on a same plane.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. A developing cartridge comprising:

a first frame comprising a first wall at one end thereof;

a second frame comprising:

a pair of second walls facing each other; and a third wall that connects the pair of second walls, wherein the first wall, the pair of second walls and the third wall define an opening;

a support that is interposed between the third wall and the first wall so as to support the first wall by the third wall;

a developer carrier that is exposed to the opening;

a layer thickness regulation member, which is provided between the developer carrier and the first wall so as to regulate thickness of a developer on the developer carrier; and a first seal member that closes a gap between the layer thickness regulation member and the first wall.

2. The developing cartridge according to claim 1, further comprising:

a partition wall that protrudes from the second frame toward the first frame so as to partition a space between the first frame and the second frame, wherein the support protrudes from the first wall toward the second frame so as to engage with a distal end of the partition wall.

3. The developing cartridge according to claim 1, wherein the layer thickness regulation member comprises:

a first plate-shaped portion, wherein the first seal member is nipped between the first plate-shaped portion and the first wall; and a second plate-shaped portion that is bent from the first plate-shaped portion so as to extend along a surface of the first frame opposite to the second frame.

4. The developing cartridge according to claim 3, wherein both ends of the layer thickness regulation member are secured to the pair of second walls.

5. The developing cartridge according to claim 4, wherein both ends of the second plate-shaped portion are secured to the pair of second walls.

6. The developing cartridge according to claim 5, wherein the pair of second walls comprises:

a fixed portion, to which the second plate-shaped portion is secured; and a welded portion, to which the first frame is welded, wherein the fixed portion and the welded portion are provided on a same plane.

7. The developing cartridge according to claim 1, wherein the first seal member extends across the pair of second walls and the first wall.

8. The developing cartridge according to claim 1, further comprising:

a recess that is formed in one of the first frame and the pair of second walls at a side close to the opening; and a protrusion that is formed on another one of the first frame and the pair of second walls at a side close to the opening, wherein the recess and the protrusion are engaged so as to position the first frame and the second frame.

9. The developing cartridge according to claim 1, further comprising:

a weld portion, which is provided on the first frame at a side facing the second frame, and which is welded to end faces of the pair of second walls; and a second seal member, which is provided on the pair of second walls, and which is welded to the weld portion at a side close to the opening.

10. The developing cartridge according to claim 1, wherein the first wall is secured to the layer thickness regulation member.

11. An image forming apparatus comprising:

a plurality of the developing cartridges, each developing cartridge comprising:

a first frame comprising a first wall at one end thereof;

a second frame comprising:

a pair of second walls facing each other; and a third wall that connects the pair of second walls;

wherein the first wall, the pair of second walls and the third wall define an opening;

a support that is interposed between the third wall and the first wall so as to support the first wall by the third wall;

a developer carrier that is exposed to the opening;

a layer thickness regulation member, which is provided between the developer carrier and the first wall so as to regulate thickness of a developer on the developer carrier;

a first seal member that closes a gap between the layer thickness regulation member and the first wall, wherein the layer thickness regulation member comprises:

a first plate-shaped portion, wherein the first seal member is nipped between the first plate-shaped portion and the first wall; and a second plate-shaped portion that is bent from the first plate-shaped portion so as to extend along a surface of the first frame opposite to the second frame, wherein both ends of the layer thickness regulation member are secured to the pair of second walls, and wherein both ends of the second plate-shaped portion are secured to the pair of second walls, wherein the plurality of developing cartridges is arranged along a direction in which the first frame and the second frame oppose each other.

12. A developing cartridge comprising:

a first frame comprising a first wall at one end thereof;

a second frame comprising:

a pair of second walls facing each other; and a third wall that connects the pair of second walls, wherein the first wall, the pair of second walls and the third wall define an opening;

a support that protrudes from the first wall toward the third wall so as to support the first wall by the third wall.

13. The developing cartridge according to claim 12, further comprising:

a developer carrier that is exposed to the opening;

a layer thickness regulation member, which is provided between the developer carrier and the first wall so as to regulate thickness of a developer on the developer carrier; and a first seal member that closes a gap between the layer thickness regulation member and the first wall.

14. The developing cartridge according to claim 13, further comprising:

a partition wall that protrudes from the second frame toward the first frame so as to partition a space between the first frame and the second frame, wherein the support protrudes from the first wall toward the second frame so as to engage with a distal end of the partition wall.

15. The developing cartridge according to claim 13, wherein the layer thickness regulation member comprises:

a first plate-shaped portion, wherein the first seal member is nipped between the first plate-shaped portion and the first wall; and a second plate-shaped portion that is bent from the first plate-shaped portion so as to extend along a surface of the first frame opposite to the second frame.

16. The developing cartridge according to claim 15, wherein both ends of the layer thickness regulation member are secured to the pair of second walls.

17. The developing cartridge according to claim 16, wherein both ends of the second plate-shaped portion are secured to the pair of second walls.

18. The developing cartridge according to claim 17, wherein the pair of second walls comprises:

a fixed portion, to which the second plate-shaped portion is secured; and a welded portion, to which the first frame is welded, wherein the fixed portion and the welded portion are provided on a same plane.

19. The developing cartridge according to claim 13, wherein the first seal member extends across the pair of second walls and the first wall.

20. The developing cartridge according to claim 13, further comprising:

a recess that is formed in one of the first frame and the pair of second walls at a side close to the opening; and a protrusion that is formed on another one of the first frame and the pair of second walls at a side close to the opening, wherein the recess and the protrusion are engaged so as to position the first frame and the second frame.

21. The developing cartridge according to claim 13, further comprising:

a weld portion, which is provided on the first frame at a side facing the second frame, and which is welded to end faces of the pair of second walls; and a second seal member, which is provided on the pair of second walls, and which is welded to the weld portion at a side close to the opening.

22. The developing cartridge according to claim 12, wherein the first wall is secured to the layer thickness regulation member.

23. A developing cartridge comprising:

a first frame comprising a first wall at one end thereof;

a second frame comprising:

a pair of second walls facing each other; and a third wall that connects the pair of second walls, wherein the first wall, the pair of second walls and the third wall define an opening;

a support that is interposed between the third wall and the first wall so as to support the first wall by the third wall, wherein the first frame and the second frame define a developer accommodating portion that is configured to accommodate developer, and wherein the first wall and the third wall face each other with the developer accommodating portion disposed therebetween.

24. The developing cartridge according to claim 23, further comprising:

a developer carrier that is exposed to the opening;

a layer thickness regulation member, which is provided between the developer carrier and the first wall so as to regulate thickness of a developer on the developer carrier; and a first seal member that closes a gap between the layer thickness regulation member and the first wall.

25. The developing cartridge according to claim 24, further comprising:

a partition wall that protrudes from the second frame toward the first frame so as to partition a space between the first frame and the second frame, wherein the support protrudes from the first wall toward the second frame so as to engage with a distal end of the partition wall.

26. The developing cartridge according to claim 24, wherein the layer thickness regulation member comprises:

a first plate-shaped portion, wherein the first seal member is nipped between the first plate-shaped portion and the first wall; and a second plate-shaped portion that is bent from the first plate-shaped portion so as to extend along a surface of the first frame opposite to the second frame.

27. The developing cartridge according to claim 26, wherein both ends of the layer thickness regulation member are secured to the pair of second walls.

28. The developing cartridge according to claim 27, wherein both ends of the second plate-shaped portion are secured to the pair of second walls.

29. The developing cartridge according to claim 28, wherein the pair of second walls comprises:

a fixed portion, to which the second plate-shaped portion is secured; and a welded portion, to which the first frame is welded, wherein the fixed portion and the welded portion are provided on a same plane.

30. The developing cartridge according to claim 24, wherein the first seal member extends across the pair of second walls and the first wall.

31. The developing cartridge according to claim 24, further comprising:

a recess that is formed in one of the first frame and the pair of second walls at a side close to the opening; and a protrusion that is formed on another one of the first frame and the pair of second walls at a side close to the opening, wherein the recess and the protrusion are engaged so as to position the first frame and the second frame.

32. The developing cartridge according to claim 24, further comprising:

a weld portion, which is provided on the first frame at a side facing the second frame, and which is welded to end faces of the pair of second walls; and a second seal member, which is provided on the pair of second walls, and which is welded to the weld portion at a side close to the opening.

33. The developing cartridge according to claim 23, wherein the first wall is secured to the layer thickness regulation member.

* * * * *